US006390576B1

(12) United States Patent
Walburn

(10) Patent No.: US 6,390,576 B1
(45) Date of Patent: May 21, 2002

(54) FRONT FACE MOUNTING APPARATUS AND PROCESS

(76) Inventor: William L. Walburn, 109 S. Claypool Rd., Muncie, IN (US) 47303

( * ) Notice: Subject to any disclaimer, the term of this patent is extended or adjusted under 35 U.S.C. 154(b) by 0 days.

(21) Appl. No.: 09/714,362

(22) Filed: Nov. 16, 2000

(51) Int. Cl.[7] ..... A47B 88/00
(52) U.S. Cl. ..... 312/348.4; 312/348.1
(58) Field of Search ..... 312/348.1, 348.4, 312/348.2, 330.1, 334.1, 257.1, 265.6, 321.5, 270.3

(56) References Cited

U.S. PATENT DOCUMENTS

| | | | | |
|---|---|---|---|---|
| 2,934,390 A | * | 4/1960 | Wright | 312/270.3 |
| 4,090,753 A | | 5/1978 | Rock et al. | |
| 4,595,245 A | | 6/1986 | Rock et al. | |
| 4,690,469 A | | 9/1987 | Grass | |
| 4,705,328 A | | 11/1987 | Rock et al. | |
| 5,211,461 A | * | 5/1993 | Teufel et al. | 312/348.4 X |
| 5,549,378 A | | 8/1996 | Grabher | |
| 5,664,857 A | | 9/1997 | Lautenschlager et al. | |
| 6,027,194 A | | 2/2000 | Fleisch | |
| 6,142,596 A | * | 11/2000 | Carson | 312/330.1 X |

FOREIGN PATENT DOCUMENTS

| | | | | |
|---|---|---|---|---|
| DE | 2808768 | * | 9/1979 | 312/348.4 |
| DE | 3632442 | * | 3/1988 | 312/348.4 |

* cited by examiner

*Primary Examiner*—Janet M. Wilkens
(74) *Attorney, Agent, or Firm*—Brinks Hofer Gilson & Lione

(57) ABSTRACT

An apparatus for adjustably mounting a drawer face panel onto a drawer slide having a plurality of holes includes a stand and an angled bracket. A first leg of the angled bracket includes a plurality of holes and slots, and the second leg includes a plurality of openings that are in general alignment with some of a plurality of holes in the stand. A first attachment engages at least one of the plurality of openings in the second leg of the angled bracket and at least one of the plurality of holes in the stand and permits adjustment of the angled bracket relative to the stand. A second attachment engages at least one of the plurality of holes in the stand and at least one of the plurality of holes in the drawer slide and permits adjustment in attaching the stand to the drawer slide.

25 Claims, 7 Drawing Sheets

FRONT FACE MOUNTING APPARATUS AND PROCESS

BACKGROUND AND FIELD OF THE INVENTION

The present invention relates generally to drawers used in cabinets or other enclosures, and more specifically to a means for adjustably mounting the face panel of a drawer so that when the drawer is closed, the drawer face panel is in flush contact with the front surface of the enclosure and into desired height, pitch, roll, lateral and skew positions with respect to the front surface of the enclosure. While the term "door" is often used in the industry to refer to any panel-like structure having vertical dimension exceeding the horizontal dimension, in the present document the term "drawer" is used to refer to any structure that is received in a sliding fashion, instead of a pivoting fashion, in a cabinet or other similar structure, regardless of its relative vertical and horizontal dimensions.

Typically, when a drawer is installed into a cabinet, the face panel of the drawer may or may not be aligned with the cabinet in any or all of three dimensions. For both aesthetic and functional reasons, it is desirable that the face of the drawer be in alignment with the cabinet itself or with the faces of any other drawers or cabinet doors that are also installed into the cabinet. The drawer face panel is typically mounted onto the drawer itself, which is mounted onto a drawer slide, or it may be mounted directly to the drawer slide. In either case, the drawer slide is mounted into the cabinet.

In the past, manufacturers have relied on tight tolerancing of the cabinet, the drawer, the drawer slide, and all the associated attachment hardware in order to yield favorable alignment of the drawer face. However, this scheme tends to be expensive due to the number of components involved and the tightness of the tolerances required to yield that favorable alignment. In those cases where the tolerances are not held sufficiently tight, for example in low cost cabinets, the drawer face alignment is poor. The problem of alignment becomes exacerbated when the drawer face is very wide or tall. Of particular concern is the tilt of the drawer panel with respect to the cabinet. Misalignment in the roll direction of a tall drawer face can result in the condition where the bottom of the face panel of a closed drawer may be in contact with the enclosure, but the top is not, yielding gap between the top of the face and the cabinet. This yields a displeasing appearance, and promotes the likelihood of dust and debris entering the drawer through the gap. Similarly, where the drawer face is skewed, i.e., where the left side of the drawer face panel touches against the enclosure when the drawer is closed, but the right side does not so touch, a displeasing appearance, and the likelihood of dust and debris entering the drawer is the result. Where the drawer face panel is not aligned properly in the height, lateral, or pitch directions, a displeasing appearance results.

However, as the state of the art improved, various schemes for adjustment of the drawer face position arose. These schemes provide an assortment of components or features, which allow for adjustment of the front panel without requiring expensively tight tolerances. However, a review of the varied existing schemes reveals that adjustment in all possible directions is not available in any single device, and that most of the offered adjustability is accomplished using the time consuming trial and error method, i.e., an adjustment is made, followed by closing the drawer and checking its position, followed by another adjustment, with this process being repeated until a suitable adjustment has been obtained.

DESCRIPTION OF THE PRIOR ART

Systems for adjusting drawer front panels have been the subject of several patents over the last few decades. In U.S. Pat. No. 6,027,194, issued to Fleisch on Feb. 22, 2000, a device for mounting a metal drawer front panel using a spring loaded device is described. This device provides for the height adjustment of the drawer face panel by the trial and error turning of an eccentric, but does not provide for lateral, pitch, roll, or skew adjustment.

In U.S. Pat. No. 5,664,857, issued to Lautenschl ger, et al, on Sep. 9, 1997, a device for permanently affixing a drawer face panel to a drawer using a bi-stable mechanical clamp is described. This invention allows for adjustment in the lateral direction and the height directions, which adjustments are made by the trial and error turning two screws, but includes no provision for roll, pitch, and skew positional adjustment.

In U.S. Pat. No. 5,549,378, issued to Grabher on Aug. 27, 1996, a device for adjusting the roll position of a drawer face panel is described. The adjustment is made by the trial and error turning a thumbscrew to adjust the drawer face panel, while a flexible member absorbs the corresponding angular displacement. There is no provision in this invention for securing the adjusted position, as the thumbscrew is not locked into its adjusted position. In addition, there is no provision for adjustment of the drawer face panel in any other direction other than the roll direction.

In U.S. Pat. No. 4,705,328, issued to Röck, et al, on Nov. 10, 1987, a mounting device for drawer front panels is described. This device provides for the height and lateral adjustments of the drawer face panel position by the trial and error turning of an eccentric and a screw, respectively, and includes no provision for adjusting the pitch, roll, and skew positions of the drawer face panel.

In. U.S. Pat. No. 4,690,469, issued to Grass on Sep. 1, 1987, a drawer front panel adjustment device is described. This device provides for adjustment of the drawer face panel in the roll direction by the trial and error sliding of a movable wedge in a vertical direction. The movable wedge acts against a stationary wedge to affect the adjustment. This device does not provide for adjustment in the height, pitch, lateral, or skew directions of the drawer face panel.

In. U.S. Pat. No. 4,595,245, issued to Röck and Brunneron Jun. 17, 1986, a fastening device for the drawer front panels is described. This device provides for adjustment of the height and lateral positions of the drawer face via the trial and error turning of adjustment screws, and for adjustment in the roll direction by the trial and error turning of an eccentric, which, after completion of the adjustment, is secured by a clamping screw. The Röck and Brunner device does not provide for pitch and skew adjustment of the drawer face panel.

In U.S. Pat. No. 4,090,753, issued to Röck and Mages on May 23, 1978, two embodiments of a device for fastening drawer face front panels are described. These devices provide for adjustment of the height, lateral, and pitch positions of the drawer face panel. The height and pitch adjustments are made by trial and error turning of an eccentric, while the lateral adjustment is made by loosening some attachment screws, making an adjustment, and then re-tightening the screws. No roll or skew adjustment capability is provided.

SUMMARY OF THE INVENTION

The present invention provides apparatus for adjustably mounting a drawer face panel of any vertical and horizontal dimension having a center and outer lateral extremities onto a drawer slide. The drawer slide either has or can be modified to have a plurality of holes, and generally includes feet for mounting the drawer slide to the floor of the cabinet in which the present invention is to be installed. The present invention includes a stand having a plurality of holes and an angled bracket having a first leg and a second leg. The first leg of the angled bracket includes a plurality of holes and slots, and the second leg includes a plurality of openings that can be position in general alignment with some of the plurality of holes in the stand. A first attachment means engages at least one of the plurality of openings in the second leg of the angled bracket and at least one of the plurality of holes in the stand for adjustably attaching the angled bracket to the stand. A second attachment means engages at least one of the plurality of holes in the stand and at least one of the plurality of holes in the drawer slide for adjustably attaching the stand to the drawer slide.

In another aspect of the invention, a drawer face mount couples a face panel to a drawer slide in such a way as to permit adjustment of the drawer face panel relative to a perimeter of an enclosure containing the drawer slide. The invention includes a drawer slide assembly with mountings for affixing the drawer slide assembly inside the enclosure, a pair of stands having a plurality of holes that are attached to a movable portion of the drawer slide assembly, and a pair of brackets with a first leg affixable to the back of the drawer face and a second leg having a plurality of openings in general alignment with at least some of the plurality of holes in one of the stands. The drawer face mount further includes attachment means engaging at least one of the plurality of holes in each stand and at least one of the openings in each bracket for adjustably attaching each bracket to an adjacent one of the stands so that an outer portion of the drawer face can be positioned with respect to the perimeter of the enclosure.

Yet another aspect of the invention is a process for mounting a drawer face panel to a drawer slide to insure correct alignment of the drawer face panel with respect to a perimeter of an opening in an enclosure receiving the drawer. The process includes the steps of: providing mountings for the drawer slide that allow for lateral and skew adjustment of position of a fixed portion of the drawer slide within the enclosure; directly fixing a set of brackets to outer lateral extremities of the drawer face panel; coupling the set of brackets to a movable portion of the drawer slide so that the height, pitch, and roll positions of the drawer face panel can be adjusted; initially securing the mountings to the enclosure, and the brackets to the drawer slide, with such force as will permit positional adjustment of the drawer face panel with respect to a perimeter of an opening in an enclosure; uniformly contacting the drawer face panel to the enclosure opening perimeter and reopening the drawer; increasing mounting retention forces so that the lateral and skew positions of the drawer slide are secured; and increasing bracket coupling forces so that the height, pitch, and roll positions of the drawer face panel are fixed with respect to the drawer slide.

A cabinet including an enclosure and a drawer system of the present invention within the enclosure, the drawer system having a drawer face of a frame and panel construction, a drawer slide, and mountings for affixing the drawer slide to the enclosure. The mountings include at least one bracket for mounting the drawer face onto the drawer slide, and a plurality of various fastener devices to affix the aforementioned components together and to secure the drawer system into the enclosure. Of particular interest is an L-shaped stand having a plurality of holes that is fixed to the drawer slide, and an angled bracket that has a first leg fixed to the peripheral frame of the drawer face and a second leg with a plurality of openings in general alignment with at least some of the plurality of holes in the stand. The second leg of the angled bracket includes an L-shaped slot that is in general alignment with one of the plurality of holes in the stand, where the vertical leg of the L-shaped slot has a width greater than that of the hole in the stand in general alignment therewith, and also includes a second slot.

These structural features of the present invention allow for adjustment of the front panel without requiring expensively tight tolerances, and without requiring time-consuming repeated trial and error adjustments of the front panel relative to the surrounding frame. The present invention can best be employed with any conventional drawer slide hardware that includes, or is modified to include, feet for mounting the drawer slide to the floor of the cabinet. The invention can be particularly employed to refurbish cabinets having a space, previously closed by a pivoted door of a given vertical and horizontal dimension, to include a sliding support for a waste basket or other utility device, and a mounting system for mounting a drawer front of the same vertical and horizontal dimension as the pivoted door to the sliding support in a fully and easily adjustable manner. These and other features and advantages of the present invention will become apparent to those skilled in the art from the following description of a preferred embodiment of the present invention that is illustrated in the accompanying drawings.

DETAILED DESCRIPTION OF THE PREFERRED EMBODIMENT

Figure 1:
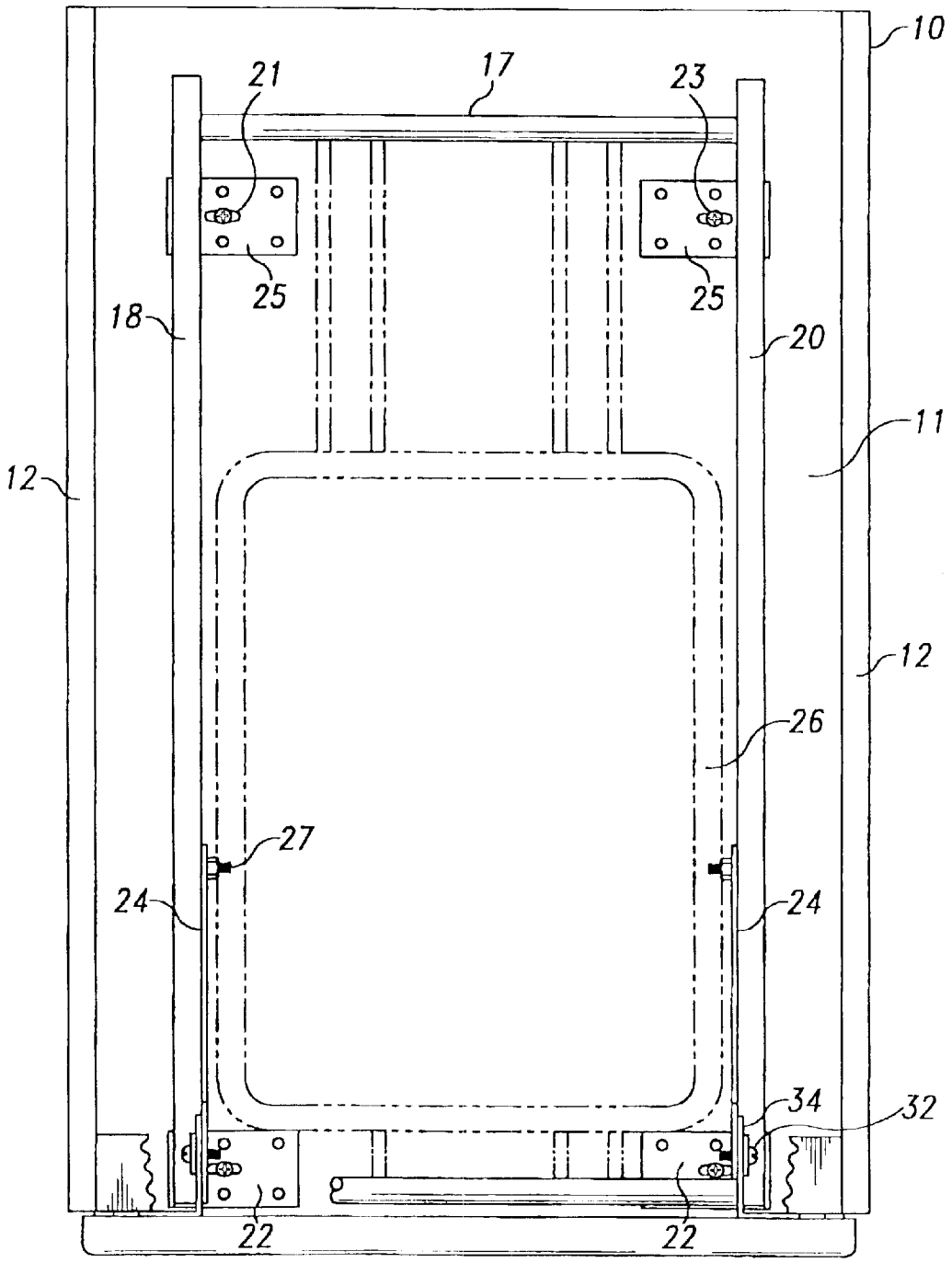
FIG. 1 is a top view of the present invention as situated in an enclosure and adapted as a wastebasket holder, with the top of the enclosure not shown.
Figure 2:
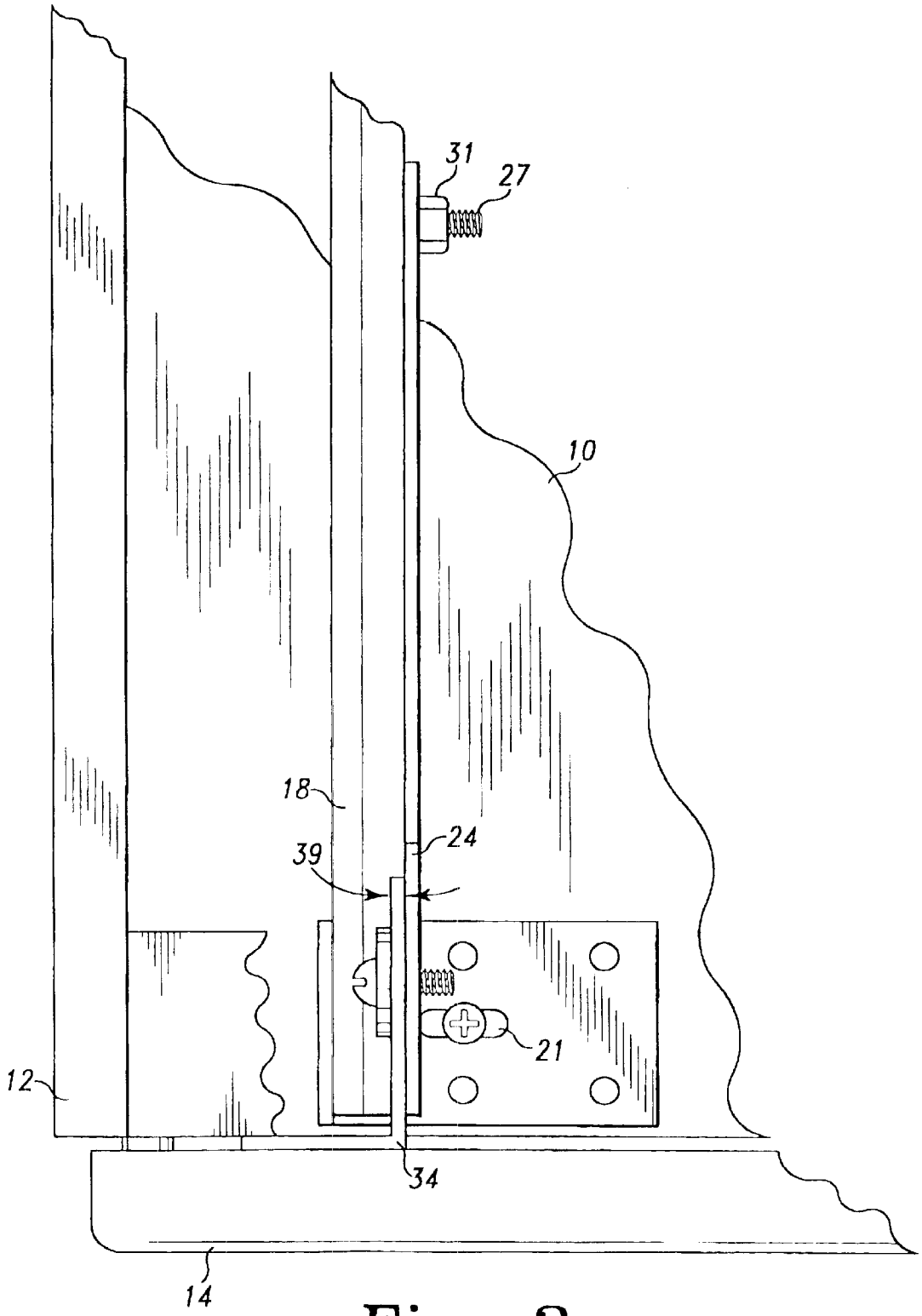
FIG. 2 is an enlargement of the lower left portion of FIG. 1 particularly illustrating the top view of certain components of the invention.
Figure 3:
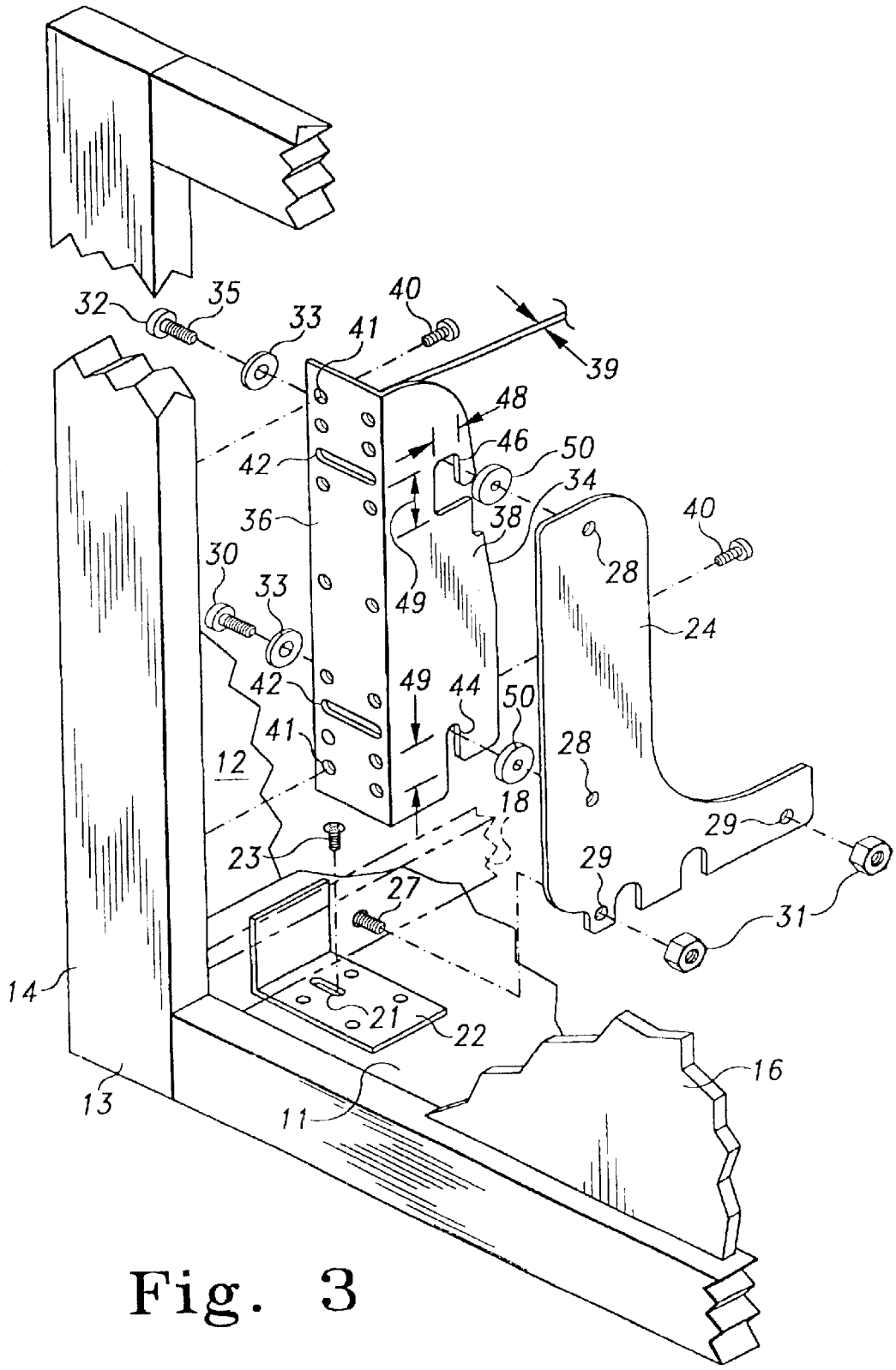
FIG. 3 is an exploded perspective view of the invention, which illustrates the invention as adapted for use with a drawer face of frame and panel construction, the panel having been cut away for purposes of clarity.

Referring to FIG. 1, FIG. 2, and FIG. 3, an apparatus is depicted for adjustably mounting a drawer face panel 13 having and outer portion into a desired position relative to an enclosure 10. It is to be understood that the enclosure 10 may be a kitchen or bathroom cabinet, a paper file cabinet, a tool chest, an industrial or consumer storage cabinet, or any of a variety of enclosures used for housing any of a variety of objects. The enclosure incorporates an enclosure floor 11 and enclosure side walls 12. The drawer face panel 13 may be a solid piece of wood, a composite structure comprising a variety of materials, or may be of frame and panel construction, including a face frame 14 and a decorative panel 16. A conventional drawer slide assembly 17 comprising a left drawer slide rail 18 and a right drawer slide rail 20 is installed into enclosure 10. Left drawer slide rail 18 and right drawer slide rail 20 each comprise both a movable portion and a fixed portion, and both further include a drawer slide forward attachment mount 22 and drawer slide rear attachment mountings 25, both of which are permanently attached to the fixed portions of left drawer slide rail 18 and right drawer slide rail 20. Drawer slide forward attachment mountings 22 and drawer slide rear attachment mountings 25 each incorporate drawer slide adjustment slots 21. Two stands 24 are attached to drawer slide assembly 17, one onto left drawer slide rail 18 and one onto right drawer slide rail 20. Also attached to or a part of drawer slide assembly 17 is a waste basket holder 26 or any other desired utility device. Examples of such utility devices may include a cutlery station, a lazy susan, a pot or pan holder, a wine rack, a paper file organizer, a tool or appliance holder or storage compartment, or any other such item that a typical homeowner or business operator may wish to have slide out access to in a cabinet or another similar such enclosure. Two angled brackets 34 are attached to a rear surface or back of drawer face panel 13, and to each stand 24.

As seen in FIG. 3, the stand 24 is L-shaped, having a vertical leg, a horizontal leg, and a plurality of holes, including at least two machine threaded holes 28, and at least two holes 29. The threaded holes 28 are located in the vertical leg of stand 24, and the holes 29 are located in the horizontal leg. The angled bracket 34 includes a first leg 36 and a second leg 38, which is at a right angle relative to first leg 36. The first leg 36 comprises a plurality of slots, including at least two drawer face attachment slots 42, and a plurality of drawer face attachment holes 41, as depicted in FIG. 3. The second leg 38 comprises a plurality of openings, including an L-shaped slot 46 and a downwardly opening second slot 44. The L-shaped slot 46 and the second slot 44 are in general alignment with the threaded holes 28 of stand 24.

The installation and operation of the invention is as follows: One of the angled brackets 34 is attached to each side of the drawer face panel 13. If the drawer face panel 13 comprises a frame and panel construction with face frame 14 and decorative panel 16, the angled brackets 34 are affixed to the face frame 14. In either case, the angled brackets 34 are attached in a vertical orientation to each of two sides of drawer face panel 13 such that the first leg 36 extends laterally away from a center of drawer face panel 13 and towards outer lateral extremities of drawer face panel 13. The angled brackets 34 are secured to drawer face panel 13 with drawer face attachment screws 40, with said screws being received into either the drawer face attachment holes 41 and/or the drawer face attachment slots 42 of angled bracket 34. The attachment holes 41 and slots 42 are preferably countersunk, coined or chamfered to that the attachment screws 40, which are preferably flat-head screws, are received into the material forming the angled bracket 34 so that the screws do not constitute an impediment to the desired close fit between the drawer face panel 13 and the enclosure 10. It will be understood that in other applications contemplated by the invention, the angled brackets 34 could be positioned in a horizontal orientation along a top and a bottom portion of drawer face panel 13.

A stand 24, is attached to each of left drawer slide rail 18 and right drawer slide rail 20, wherein a set of two stand attachment studs 27 that extend from each of left drawer slide rail 18 and right drawer slide rail 20 are received into the two holes 29 in each stand 24. The positioning of the two stand attachment studs in the slide rails 18 and 20 can be facilitated through the use of a suitable template, not shown. Stand attachment nuts 31 are used to engage stand attachment studs 27 to secure each stand 24 to its respective left drawer slide rail 18 or right drawer slide rail 20. Alternatively, the studs 27 and attachment nuts 31 can be replaced by rivets that fix the two stands 24 to the drawer slides 18 and 20. Washer 33 is placed onto a threaded major diameter portion 35 of adjusting bolt 32, and adjusting bolt 32 is partially threaded into the upper threaded hole 28, leaving a gap between washer 33 and stand 24 of sufficient width as to readily receive a second leg thickness 39 of angled bracket 34, wherein the washer 33 is positioned against a head of the adjusting bolt 32. A pivot bolt 30 is partially threaded into the lower threaded hole 28, leaving a gap between a head of pivot bolt 30 and stand 24 of sufficient width as to readily receive a second leg thickness 39 of angled bracket 34.

The drawer slide assembly 17 is placed onto the enclosure floor 11, in an approximately centered position between the enclosure side walls 12, with the drawer slide forward attachment mountings 22 positioned adjacent to a front edge of the enclosure floor 11. One of the drawer slide attachment screws 23 is used to partially secure each drawer slide forward attachment mount 22 and each drawer slide rear attachment mount 25 to the enclosure floor 11. This is accomplished by engaging the drawer slide attachment screws 23 through drawer slide adjustment slots 21 and into enclosure floor 11, and partially tightening each drawer slide attachment screw 23 to such a degree that drawer slide assembly 17 is clamped to enclosure floor 11, subject to being moved by the application of a force by the human hand without the use of tools, whereas a further tightening of each drawer slide attachment screw 23 would render the drawer slide assembly 17 incapable of being moved by the application of a hand force without the use of tools.

The drawer face panel 13 with affixed angled brackets 34 is positioned in front of the enclosure 10, with the stands 24 immediately adjacent to the angled brackets 34, wherein the L-shaped slot 46 of each angled bracket 34 is positioned immediately adjacent to the corresponding adjusting bolt 32 so as to receive adjustment bolt 32 between washer 33 and stand 24, and wherein the second slot 44 is also positioned immediately adjacent to the corresponding pivot bolt 30 so as to receive pivot bolt 30 between the head of pivot bolt 30 and stand 24. The drawer face panel is pushed towards the enclosure and in a downward direction until the L-shaped slot 46 and second slot 44 of each angled bracket 34 have received the adjusting bolts 32 and pivot bolts 30, respectively. The adjusting bolts 32 and pivot bolts 30 are tightened to about finger tight, so as to partially secure the angled brackets 34 to the stands 24 to a degree as would allow the angled brackets 34 to move relative to the stands 24 upon the application a force of a human hand without the use of tools.

The drawer face panel 13 is positioned relative to enclosure 10 by closing drawer face panel 13 against enclosure 10, and by forcing it by hand flush with enclosure 10 into desired height, pitch, roll, lateral and skew positions. It will be appreciated by those skilled in the art that in a typical installation, the drawer face panel 13 is conventionally spaced from the enclosure by small rubber or plastic bumpers, not shown, located at the corners of the drawer face panel 13, which still permit the necessary alignment of the drawer face with the surrounding enclosure 10, and that the phrase "flush with" includes such uniform separation as can be achieved with the bumpers so located. Once positioned, the drawer face panel 13 is pulled away from enclosure 10, and each drawer slide attachment screw 23 is fully tightened to securely affix drawer slide assembly 17 to enclosure floor 11. The adjusting bolts 32 and pivot bolts 30 are fully tightened so as to completely secure the angled brackets 34 to the stands 24. Optional spacers 50 can be inserted between the angled brackets 34 and the stands 24 to permit additional laterally outward spacing of the angled brackets 34 where the drawer face panel dimensions require such spacing.

From the foregoing, it can be seen that the invention allows a simple and expedient means of positioning the drawer face panel 13 relative to the enclosure 10. No adjustments are necessary once the drawer face panel 13 is placed into the desired position and the drawer slide attachment screws 23, adjusting bolts 32, and pivot bolts 30 are fully tightened. Unlike other means of positioning such panels, it will be appreciated by those skilled in the art that there is no need for trial and error adjustment, i.e., no need to make an initial assessment of the drawer face panel 13 position, make an adjustment, check for desired position with the door closed, readjust, recheck, and readjust. The invention allows for a single act of positioning the drawer face panel 13 followed by fully tightening the drawer slide attachment screws 23, the adjusting bolts 32, and the pivot bolts 30, saving installation time and effort, which reduces labor cost and enhances customer satisfaction. In addition, it is important to note that the invention allows for adjustment in all directions. These advantages of the invention are the result of the design of angled bracket 34 and stand 24 which allow for height, pitch, and roll position adjustment of drawer face panel 13, and of the drawer slide adjustment slots 21, which allow for lateral and skew adjustment of the drawer slide assembly 17, hence of drawer face panel 13 which is connected to drawer slide assembly 17 via angled brackets 34 and stands 24. Here, the term, height, refers to adjustment in the vertical direction, i.e., up and down, the term, pitch, refers to the adjustment required to prevent drawer face panel 13 from leaning to the left or to the right, i.e., as if pivoting drawer face panel 13 about a line perpendicular to and passing through a center of drawer face panel 13, and the term, roll, pertains to the adjustment necessary to render drawer face panel 13 in contact with enclosure 10 at both upper and lower extremities of drawer face panel 13, i.e., as if pivoting drawer face panel 13 about a horizontal line which passes through the center of that drawer face panel. The term, lateral, refers to adjustment of drawer face panel 13 in a horizontal direction, i.e., to the left and to the right, while the term, skew, pertains to the adjustment required to render drawer face panel 13 in contact with enclosure 10 at both left and right extremities of drawer face panel 13, i.e., as if pivoting drawer face panel 13 about a vertical line that passes through the center of that drawer face panel.

The L-shaped slot 46 and second slot 44, acting in conjunction with adjusting bolt 32 and pivot bolt 30, provide for height, pitch, and roll adjustment of drawer face panel 13. In operation, these adjustments would be made by manually pushing drawer face panel 13 into desired height, pitch, and roll positions relative to enclosure 10 while the adjusting bolts 32 and pivot bolts 30 are only about finger tight, as previously described. After adjustment, adjusting bolts 32 and pivot bolts 30 would be fully tightened in order to retain drawer face panel 13 secured in its adjusted height, pitch, and roll positions. Importantly, a vertical leg width 48 of L-shaped slot 46 is wide in comparison to upper threaded hole 28 and thread major diameter 35 of adjusting bolt 32, thereby permitting roll adjustment of drawer face panel 13, pivoting about pivot bolt 30, which is received into second slot 44. The roll position of drawer face panel 13 at one extreme takes place where the thread major diameter 35 of adjusting bolt 32 contacts a forward edge of the vertical leg of L-shaped slot 46, and is at the opposite extreme where a rearward edge of the vertical leg of the L-shaped slot is contacted by the thread major diameter 35. The vertical leg width 48 is selected so as to allow ample adjustment of the roll position to compensate for manufacturing tolerances so that the drawer face panel 13 may be mounted flush with enclosure 10.

Owing to the vertical extents 49 of both L-shaped slot 46 and second slot 44, height and pitch adjustment of drawer face panel 13 is also provided by the invention. The vertical extents 49 of L-shaped slot 46 and second slot 44 are selected so as to allow ample adjustment in the height and pitch directions to compensate for manufacturing tolerances so that the drawer face panel 13 may be mounted in desired height and pitch positions with respect to enclosure 10. Because of the vertical extents 49 of L-shaped slot 46 and second slot 44, the angled bracket 34, hence drawer face panel 13, may be moved up or down into a desired vertical position, while receivably maintaining the adjusting bolt 32 and the pivot bolt 30 inside confines of L-shaped slot 46 and second slot 44, respectively, prior to fully tightening adjusting bolts 32 and pivot bolts 30.

Similarly, a left side of drawer face panel 13 may be moved up or down relative to a right side of drawer face panel 13, and/or the right side of drawer face panel 13 relative to the left side, in order to adjust the pitch position of drawer face panel 13, prior to fully tightening adjusting bolts 32 and pivot bolts 30. On each the left and or right side of drawer face panel 13, this specifically involves moving the angled bracket 34 on one side up or down relative to the stand 24 on that same side, hence the L-shaped slot 46 and second slot 44 on that same side up or down relative the adjusting bolt 32 and pivot bolt 30 on that same side.

These height, pitch, and roll adjustment features allow compensation where manufacturing tolerances have prevented a perimeter of an opening in enclosure 10, defined by front edges of a top of the enclosure 10, front edges of enclosure side walls 12, and a front edge of enclosure floor 11 from being perfectly square with respect to enclosure 10, or where enclosure floor 11 is not aligned square and true with said perimeter. In addition, these features also allow compensation for manufacturing tolerances in the drawer slide assembly 17, the stand 24, the angled bracket 34, and any other components or features which may affect the tolerance stack in misalignment directions between drawer face panel 13 and enclosure 10.

Advantageously, the invention also allows for lateral and skew adjustment via drawer slide adjustment slots 21 and drawer slide attachment screws 23. In operation, these adjustments would be made by manually pushing drawer face panel 13 into desired lateral and skew positions relative to enclosure 10 while the drawer slide attachment screws 23 are only partially tightened, as previously described. After adjustment, drawer slide attachment screws 23 would be fully tightened in order to retain drawer face panel 13 secured in its adjusted lateral and skew positions. The adjustments are possible by virtue of a length and width of drawer slide adjustment slots 21 relative to a diameter of drawer slide attachment screws 23. When drawer slide attachment screws 23 are only partially tightened, drawer slide forward attachment mountings 22 and drawer slide rear attachment mountings 25 may be moved in the lateral directions, both to the same or different degree of movement, hence providing for both lateral and skew adjustment of drawer face panel 13 through its connection to drawer slide assembly 17 via angled brackets 34 affixed to stands 24, affixed to left drawer slide rail 18 and right drawer slide rail 20. For example, when drawer slide attachment screws 23 are only partially tightened, if both the forward and rear drawer slide attachment mounts 22 and 25, respectively, are moved in the same lateral direction and with the same magnitude of displacement, it can be seen that the drawer face panel 13 would be moved in the same lateral direction and magnitude as the forward and rear drawer slide attachment mounts 22 and 25, respectively. However, if the drawer slide forward attachment mountings 22 were moved, for example, to the left, and the drawer slide rear attachment mountings 25 were moved to the right, the motion of drawer face panel 13, while possibly including lateral motion, would definitively include motion in the skew direction, as previously defined.

As with the height, pitch, and roll adjustment, the lateral and skew adjustment allow compensation where manufacturing tolerances have prevented the perimeter of the opening in enclosure 10, defined by front edges of a top of the enclosure 10, front edges of enclosure side walls 12, and a front edge of enclosure floor 11 from being perfectly square with respect to enclosure 10, or where enclosure floor 11 is not aligned square and true with said perimeter. Similarly, these features also allow compensation for manufacturing tolerances in the drawer slide assembly 17, the stand 24, the angled bracket 34, and any other components or features which may affect the tolerance stack in misalignment directions between drawer face panel 13 and enclosure 10.

Note that additional lateral adjustment capability of drawer face panel 13 may be obtained through the use of the drawer face attachment slots 42 in angled bracket 34. This would be accomplished by inserting drawer face attachment screws 40 through drawer face attachment slots 42, as opposed to drawer face attachment holes 41, and initially only partially tightening drawer face attachment screws 40. After positioning of drawer face panel 13 as discussed previously, drawer face attachment screws 40 would be fully tightened.

A significant feature of the invention is that it may be used with a drawer face panel 13 of frame and panel construction, comprising a face frame 14 with a floating nonstructural decorative panel 16. As will be appreciated by those skilled in the art, cabinetry drawer faces and doors often comprise such frame and panel construction, where a decorative panel such as decorative panel 16 floats inside a frame, such as face frame 14, retained only by interior grooves located in inner edges of that frame, which circumscribe the decorative panel. The purpose of such frame and panel construction is often to allow a wooden decorative panel 16 to expand or contract as temperature and humidity conditions change, without affecting the exterior dimensions of the overall frame and panel construct. Additionally, it is often the case that the decorative panel 16 is intended purely for aesthetic purposes, and does not have sufficient structural capacity to be used in mounting the frame and panel construct, i.e., it may be made of a thin material such as wood, glass, ceramic, or some polymer composite. In such cases, existing designs require the incorporation of an intermediate structural panel affixed to the frame of the frame and panel construct, as those designs are not capable of being adapted to fixation directly to the frame, for example, the attachment features or components may be located too far from the outer lateral extremities of the frame and panel construct to allow for fixation directly to the frame.

The combinations of features in the present invention, however, including the angled bracket 34 and stand 24, allow for affixment directly to face frame 14, eliminating the need for such intermediate structural panels. This allows for a lower cost to the manufacturer and consumer, and results in a lesser space claim or footprint, owing to the absence of such an intermediate structural panel, which provides either a smaller external dimension of the enclosure in which the invention is used, or a larger interior storage space inside that enclosure, or a combination of each. This important advantage is at least partially owing to angled brackets 34, which reaches laterally outward from the drawer slide, to attach to the drawer face panel 13 with face frame 14. In addition, the advantage is at least partially owing to stands 24, which are positioned immediately adjacent to left drawer slide rail 18 and right drawer slide rail 20, which positions place stands 24 in close proximity for attachment to angled brackets 34. Additionally, the optional spacers 50 allow for a variety of widths of panels to be fixed to slides of a fixed lateral dimension.

Figure 4B:
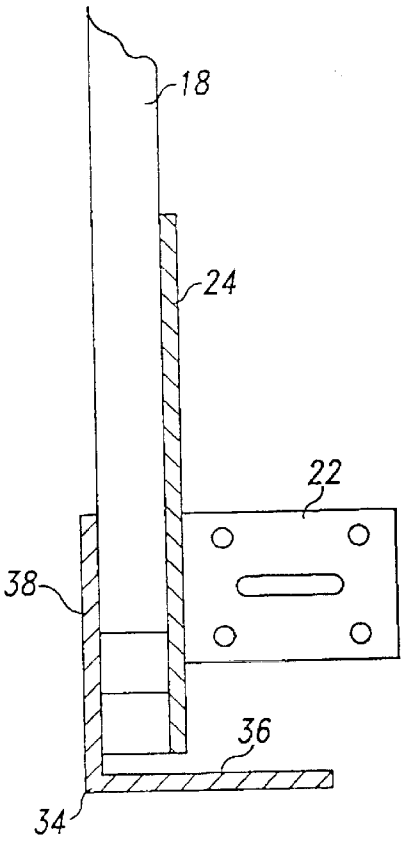
FIGS. 4A–4H are schematic views similar to FIG. 2 showing variations in assembly that can be achieved with the components of the invention.
Figure 4A:
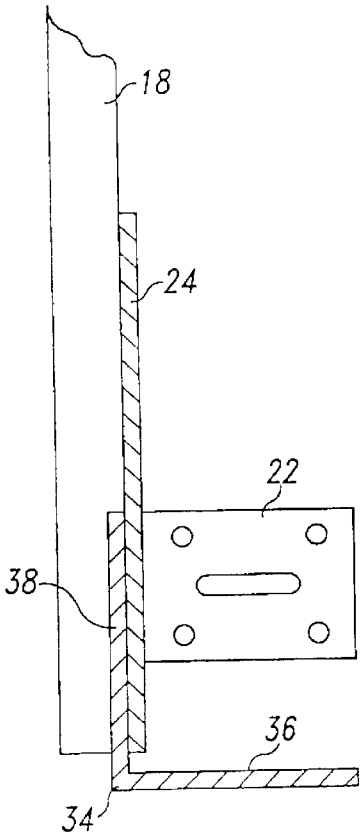
Figure 4D:
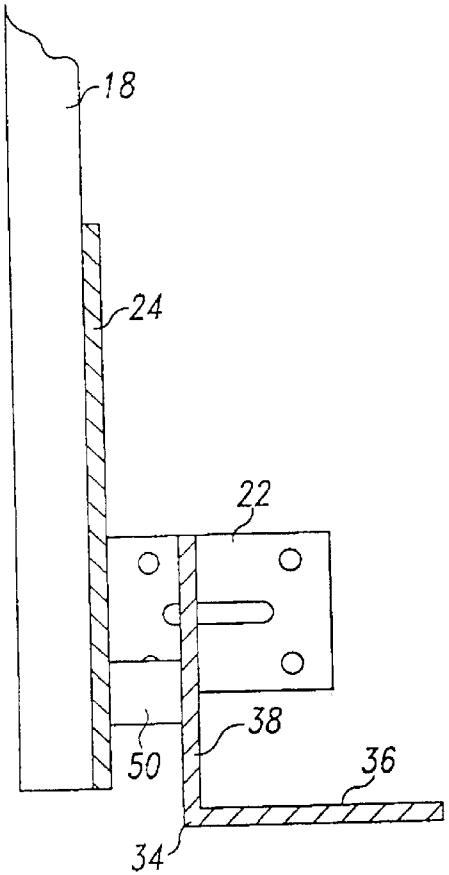
Figure 4C:
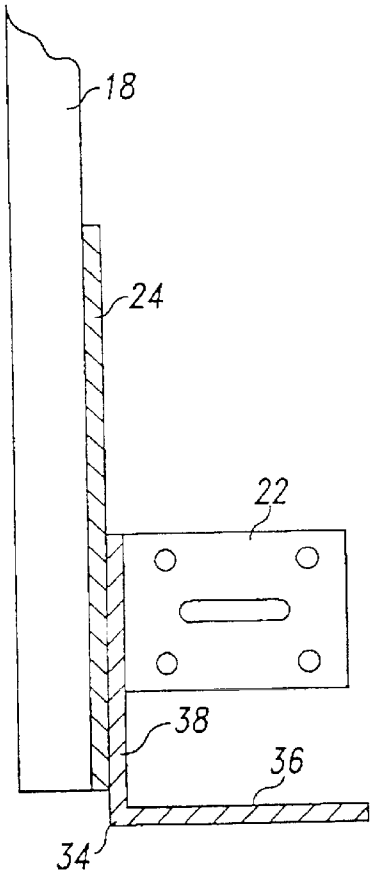
Figure 4F:
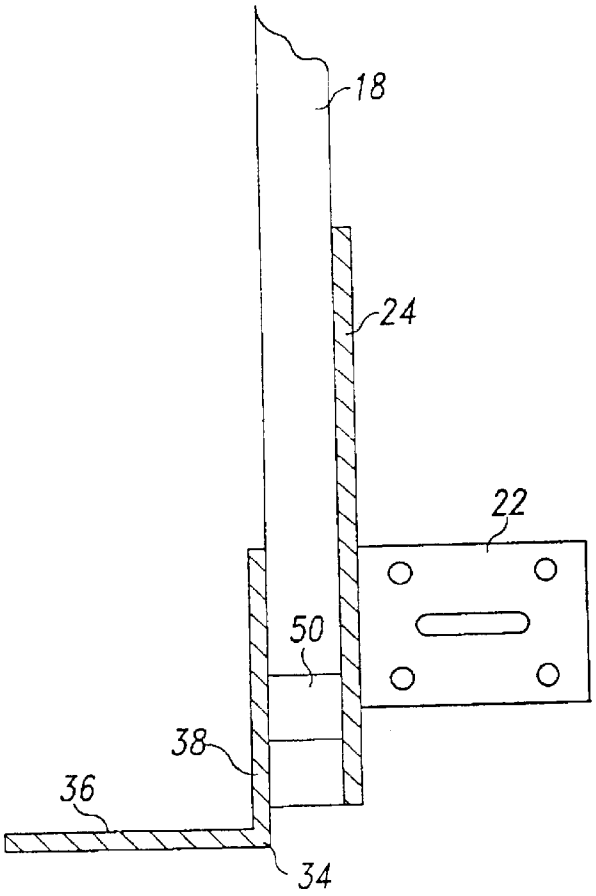
Figure 4E:
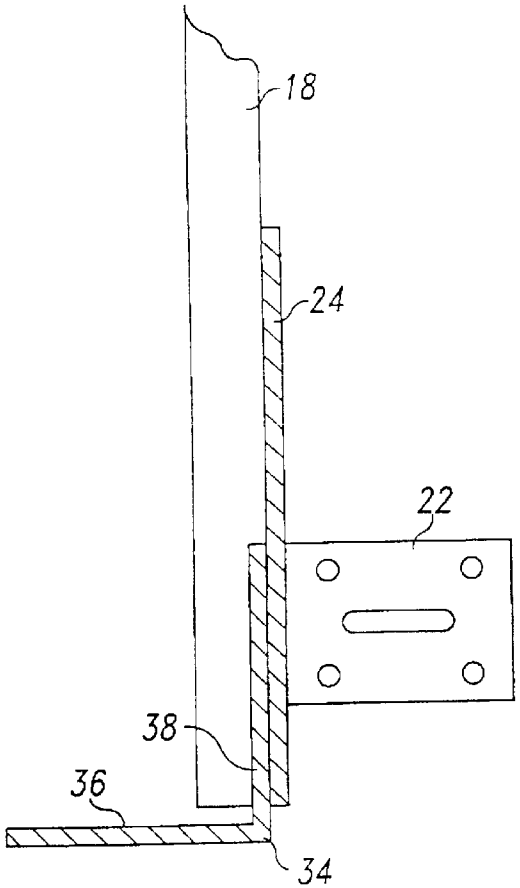
Figure 4H:
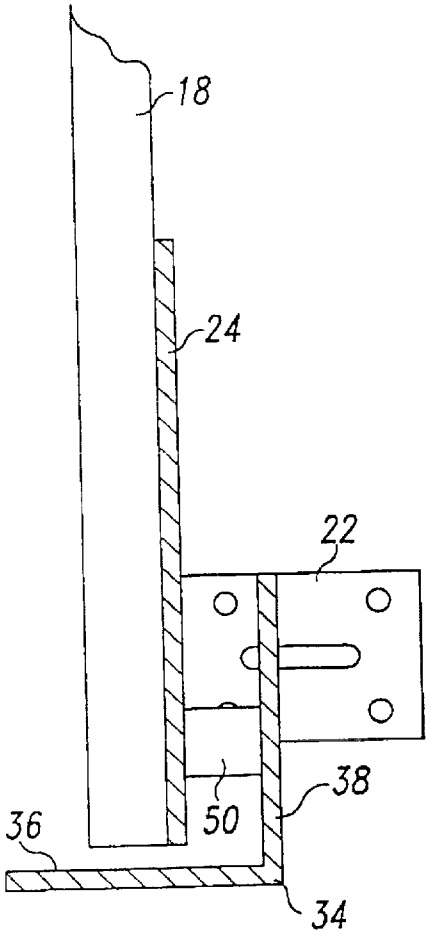
Figure 4G:
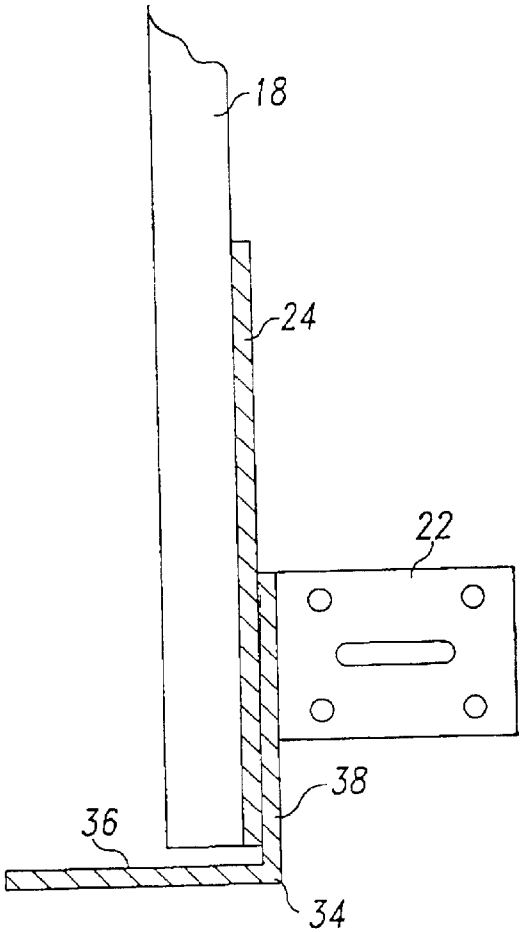

The variety of widths of drawer face panels that can be accommodated is illustrated in the variety of arrangements shown in FIGS. 4A through 4H which are schematic views showing the left drawer slide 18 with the drawer slide forward attachment mount 22 and stand 24 attached to drawer slide in the same manner as that shown in FIG. 2. The arrangements shown in FIGS. 4A–4H illustrate possible variations in attachment of the angled bracket 34 to the stand 24, both with and without spacer 50. In FIGS. 4A–4D, the angled bracket 34 is situated so that the first leg 36 is inwardly directed relative to the second leg 38, while in FIGS. 1–3 and 4E–4H, the first leg 36 is outwardly directed. In FIGS. 4A, 4B, 4E and 4F, the angled bracket 34 is connected to the outside of stand 24, while in FIGS. 4C, 4D, 4G and 4H the angled bracket 34 is connected to the inside of stand 24. The arrangement shown in FIG. 4E is identical to that shown in FIG. 2, while the arrangement shown in 4F is identical to that shown in FIG. 3. FIGS. 4D and 4F represent the two extremes of position of the first leg 36 relative to the stand 24, while the remaining FIG. 4 arrangements position the first leg 36 at some intermediate position. The variety of positions of the first leg 36 permit the single assembly to be employed with a wide variety of drawer face panels, whether solid or employing a face frame and decorative panel construction.

The invention is also especially important where it is adapted for use as an in-cabinet wastebasket holder or similar such in-cabinet utility system, including a cutlery station, a lazy susan, a slide-out wine rack, a pot or pan holder, a paper file organizer, a tool or appliance holder or storage compartment, as these aforementioned features allow the use of a larger wastebasket holder, drawer, or other utility system than would otherwise be permitted by the interior dimensions absent the invention. Conversely, the smaller space claim or footprint afforded by the invention allows for its installation into smaller quarters than would be otherwise permitted absent the invention.

While the invention has been described with reference to the preferred embodiment illustrated in the accompanying drawings, variations of the invention will be apparent to those skilled in the art, which are still within the scope and spirit of the invention as previously summarized and hereafter claimed.

What is claimed is:

1. A drawer face panel having a rear surface including a center and outer lateral extremities, a drawer slide, and apparatus for adjustably mounting the drawer face panel to the drawer slide which comprises:

(a) a stand having a plurality of holes;

(b) an angled bracket having a first leg, a second leg, a plurality of holes and a plurality of slots in the first leg, and a plurality of openings in the second leg in general alignment with at least some of the plurality of holes in the stand;

(c) first attachment means engaging at least one of the plurality of openings in the second leg of the angled bracket and at least one of the plurality of holes in the stand for adjustable attaching the angled bracket to the stand; and (d) second attachment means engaging at least one of the plurality of holes in the stand and the drawer slide for adjustably attaching the stand to the drawer slide.

2. The apparatus of claim 1, wherein the first log of the angled bracket is positioned parallel to the rear surface of said drawer face panel and extending laterally away from the center of the drawer face panel and affixes to the outer lateral extremities of the drawer face panel so as to avoid the necessity of an intermediate structural member between any outer frames of the drawer face panel, and wherein the second leg is perpendicular to the first leg.

3. The apparatus of claim 2, wherein a first of the plurality of openings in the second leg comprises an L-shaped slot wherein a vertical leg of the L-shaped slot has a width greater than that of the hole in the stand in general alignment therewith, and a second of the plurality of openings in the second leg is a second slot.

4. The apparatus of claim 3, wherein said first attachment means comprises:

(a) third means for adjustably engaging said L-shaped slot to affix the second leg with the stand, and (b) fourth means for adjustably engaging the second slot to affix the second leg with the stand.

5. The apparatus of claim 4, wherein the third means comprises:

(a) a first part of a fastener combination receivable into one of said plurality of holes in the stand and also receivable into the L-shaped slot; and (b) a second part of the fastener combination engaged with the first part, and acting in conjunction with the first part to affix the second leg with the stand.

6. The apparatus of claim 5, wherein the third means further comprises spacer means for spacing the second leg of the angled bracket from the stand.

7. The apparatus of claim 4, wherein said fourth means comprises:

(a) a first part of a second fastener combination receivable into a second of said plurality of holes in the stand and also receivable into said second slot; and (b) a second part of the second fastener combination engaged with the first part, and acting in conjunction with the first part to affix the second leg of the angled bracket with the stand.

8. The apparatus of claim 7, wherein the fourth means further comprises spacer means for spacing the second leg of the angled bracket from the stand.

9. The apparatus of claim 1, further comprising mountings for affixing said drawer slide inside an enclosure, the mountings including lateral slots allowing lateral and skew adjustment of the drawer slide.

10. An enclosure having an opening defined by a perimeter, a drawer face panel having an outer portion dimensioned to overlap the perimeter, a drawer slide assembly having a fixed portion and a movable portion, and a drawer face mount for mounting the drawer face panel to the drawer slide assembly to permit adjustment of the drawer face panel relative to the perimeter of the enclosure containing the drawer slide, the drawer face mount comprising:

(a) mountings for affixing the fixed portion of said drawer slide assembly inside said enclosure;

(b) a pair of stands attached to a movable portion of the drawer slide assembly, the stands having a plurality of holes;

(c) a pair of brackets having a first leg affixable to a back of said drawer face panel and a second leg having a plurality of openings in general alignment with at least some of the plurality of holes in one of the stands; and (d) attachment means engaging at least one of the plurality of holes in each stand and at least one of the openings in each bracket for adjustably attaching each bracket to an adjacent one of the stands so that the outer portion of the drawer face panel can be positioned with respect to said perimeter of the enclosure.

11. The drawer face mount of claim 10, wherein the first leg of each bracket is positioned parallel to a rear surface of said drawer face panel and extends laterally outwardly from the adjacent stand to a position to overlap the outer portion on one side of the drawer face panel and the second leg of said angled bracket is perpendicular to the first leg.

12. The drawer face mount of claim 11, wherein one of the plurality of openings in the second leg of each bracket comprises an L-shaped slot having a width greater than that of said hole in the adjacent stand in general alignment therewith.

13. The drawer face mount of claim 12, wherein another of the plurality of openings in the second leg of each bracket comprises a downwardly opening slot.

14. The drawer face mount of either claim 12 or 13, wherein said attachment means comprises a fastener passing through the L-shaped slot in one of the brackets and through one of the plurality of holes in each stand, the fastener having force adjustment means for adjusting the compressive force applied to the adjacent bracket and stand.

15. The drawer face mount of claim 14, wherein the force adjustment means comprises threads machined into at least one of the plurality of holes in the stand, engaging threads circumscribing the fastener.

16. The drawer face mount of claim 13, wherein said attachment means comprises a fastener passing through the downwardly opening slot in one of the brackets and through one of the plurality of holes in each stand.

17. The drawer face mount of claim 16, wherein the fastener further comprises spacers spacing the second leg of the angled bracket from the stand.

18. The drawer face mount of claim 10, wherein said mountings include means permitting lateral and skew adjustment of said slide assembly with respect to said enclosure.

19. The drawer face mount of claim 10, wherein said drawer slide assembly comprises an in-cabinet wastebasket holder.

20. A process for mounting a drawer face panel to a drawer slide to insure correct alignment of the drawer face panel with respect to a perimeter of an opening in an enclosure receiving the drawer slide, the process comprising the steps of:

(a) providing mountings for said drawer slide that allow for lateral and skew adjustment of position of a fixed portion of the drawer slide within said enclosure;

(b) directly fixing a set of brackets to outer lateral extremities of said drawer face panel;

(c) coupling the set of brackets to a movable portion of the drawer slide so that the height, pitch, and roll positions of the drawer face panel can be adjusted;

(d) initially securing the mountings to the enclosure, and the brackets to the drawer slide, with such force as will permit positional adjustment of the drawer face panel with respect to the perimeter of the opening in the enclosure;

(e) uniformly contacting the drawer face panel to the enclosure opening perimeter and re-extending the drawer slide;

(f) increasing mounting retention forces so that the lateral and skew positions of the drawer slide are secured; and (g) increasing bracket coupling forces so that the height, pitch, and roll positions of the drawer face panel are fixed with respect to the drawer slide.

21. In a cabinet including an enclosure and a drawer system for use in the enclosure, the drawer system having a face panel and a drawer slide, the improvement comprising:

(a) an L-shaped stand having a plurality of holes, the L-shaped stand being fixed to the drawer slide; and (b) an angled bracket having a first leg fixed to the drawer face panel and a second leg having a plurality of openings in general alignment with at least some of the plurality of holes in the stand, including a first slot having a width greater than that of the hole in the stand in general alignment therewith, and further including a second slot, the second leg of the angled bracket being affixed to the L-shaped stand.

22. The improvement of claim 21 wherein the drawer slide further comprises a wastebasket holder.

23. The improvement of claim 21 wherein the first slot in the angled bracket comprises an L-shaped slot, where the vertical leg of the L-shaped slot has a width greater than that of the hole in the stand in general alignment therewith.

24. The improvement of claim 21 further comprising mountings for affixing the drawer slide to the enclosure including lateral slots permitting lateral and skew adjustment of the drawer slide with respect to the enclosure.

25. In a drawer system for use in an enclosure, including a drawer having a drawer face of frame and panel construction, a drawer slide, mountings which affix the drawer slide in the enclosure, an improved means for mounting the drawer face onto the drawer slide comprising:

(a) an L-shaped stand having a plurality of holes, the L-shaped stand being fixed to the drawer slide; and (b) an angled bracket having a first leg affixed to the frame of said drawer face and a second leg having a plurality of openings in general alignment with at least some of the plurality of holes in the stand, including an L-shaped slot, wherein the vertical leg of the L-shaped slot has a width greater than that of the hole in the stand in general alignment therewith, and further including a second slot, the second leg of the angled bracket being fixed to the L-shaped stand.

* * * * *